United States Patent [19]

Kozlowski

[11] 3,933,619

[45] Jan. 20, 1976

[54] GASOLINE PRODUCTION PROCESS

[75] Inventor: Robert H. Kozlowski, Berkeley, Calif.

[73] Assignee: Chevron Research Company, San Francisco, Calif.

[22] Filed: Oct. 12, 1973

[21] Appl. No.: 405,993

[52] U.S. Cl. ..... 208/60; 208/79; 208/80; 208/141; 260/683.68

[51] Int. Cl.[2] ..... C10G 37/10

[58] Field of Search ..... 208/60

[56] References Cited

UNITED STATES PATENTS

| | | | |
|---|---|---|---|
| 2,956,095 | 10/1960 | Schwartz | 260/683.68 |
| 3,394,202 | 7/1968 | Oelderik et al. | 260/683.68 |
| 3,678,120 | 7/1972 | Bloch | 252/441 |
| 3,788,975 | 1/1974 | Donaldson | 208/60 |

*Primary Examiner*—Herbert Levine
*Attorney, Agent, or Firm*—G. F. Magdeburger; R. H. Davies; D. L. Hagmann

[57] ABSTRACT

A process for producing high octane low lead content or unleaded gasoline from a hydrocarbon feedstock by hydrocracking the hydrocarbon feedstock; fractionating the hydrocracking effluent in a fractionation zone, thereby obtaining a stream rich in singly branched hexanes; isomerizing the singly branched hexanes to doubly branched hexanes in an isomerization zone operated at a reaction temperature below 300°F.; and combining the doubly branched hexanes with $C_7$+ hydrocarbons derived from the hydrocracking effluent, thereby obtaining a high octane gasoline or gasoline blending stock. In a preferred embodiment, the isomerization zone effluent is fractionated to give a cyclohexane-rich stream which stream is catalytically reformed and then the reformate is combined with the doubly branched hexanes from the isomerization zone.

5 Claims, 1 Drawing Figure

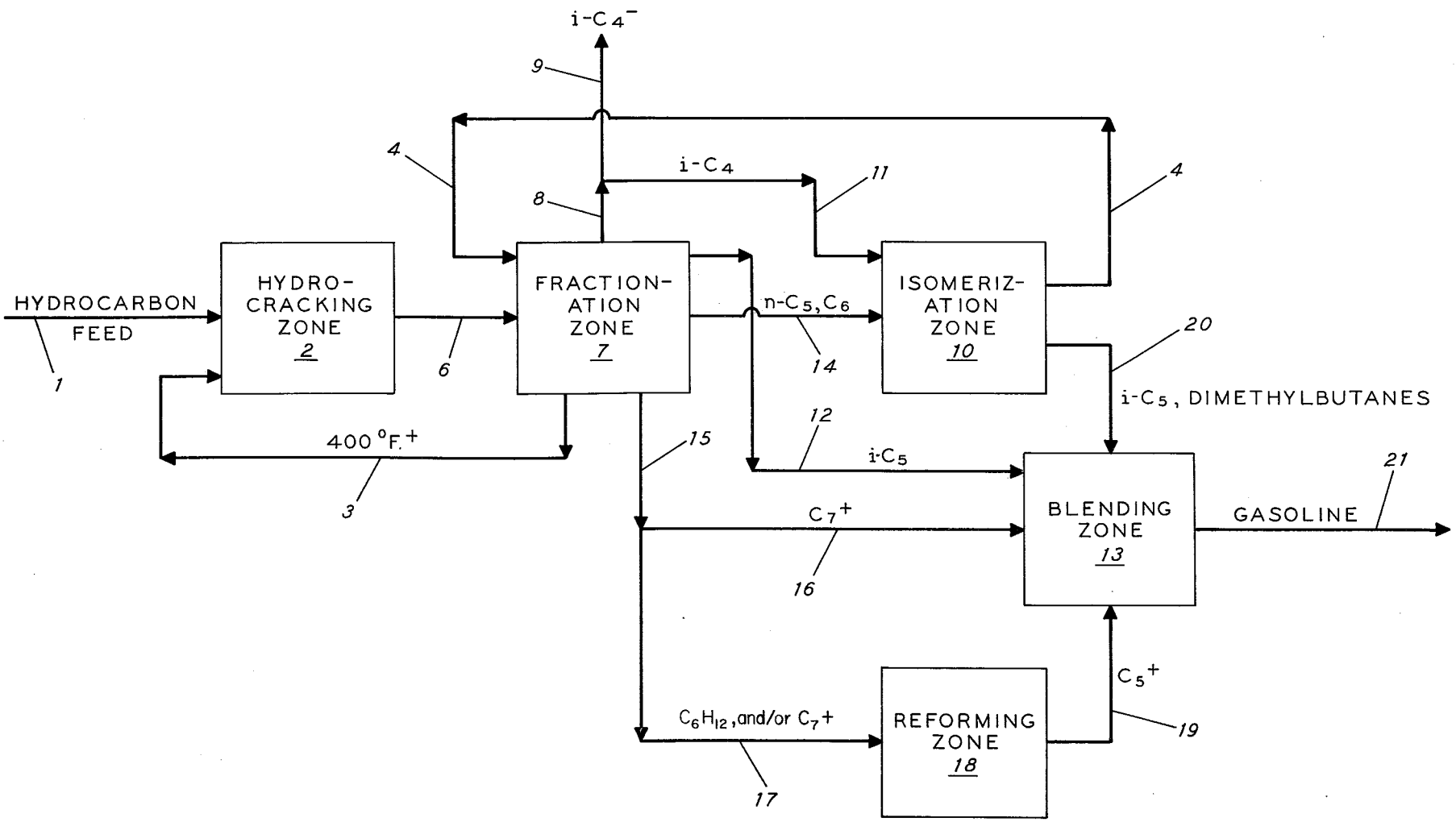
HYDROCARBON FEED
1
HYDRO-CRACKING ZONE 2
400 °F.+
3
6
FRACTION-ATION ZONE 7
4
8
9
i-C4⁻
i-C4
11
ISOMERIZ-ATION ZONE 10
n-C5, C6
14
4
i-C5, DIMETHYLBUTANES
20
12
i-C5
15
C7+
16
BLENDING ZONE 13
GASOLINE
21
C6H12, and/or C7+
17
REFORMING ZONE 18
C5+
19

GASOLINE PRODUCTION PROCESS

BACKGROUND OF THE INVENTION

The present invention relates to combined hydrocracking and isomerization.

Hydrocracking is a well-known process. Typical conditions for hydrocracking include a pressure of 100 to 10,000 psig, a temperature of 600° to 1000°F., a hydrogen rate of 100 to 10,000 standard cubic feet per barrel of feed and a catalyst such as a Group VIII metal or metal compound and/or a Group VIB metal or metal compound on a porous refractory base.

Isomerization of normal paraffins such as n-pentane, n-hexane or n-heptane is widely practiced for production of higher-octane isomers for use in gasoline.

Table I, below, shows the relatively excellent octane values for branched paraffins, i.e., the incentive for isomerization.

TABLE I

| Hydrocarbon | Research Octane Clear | Research Octane 3 cc. TEL | Motor Octane Clear | Motor Octane 3 cc. TEL |
|---|---|---|---|---|
| n-Pentane | 62 | 89 | 62 | 84 |
| i-Pentane | 92 | 109 | 90 | 105 |
| n-Hexane | 25 | 65 | 26 | 65 |
| 2-Methylpentane | 73 | 93 | 74 | 91 |
| 3-Methylpentane | 75 | 93 | 74 | 91 |
| 2,2-Dimethylbutane (neohexane) | 92 | 106 | 93 | 113 |
| 2,3-Dimethylbutane (diisopropyl) | 103 | 119 | 94 | 112 |

Isomerization processes can be divided into high, low, and ultra-low temperature processes. Rough temperature ranges are: 500°–800°F. for high temperature isomerization; 150°–400°F. for low temperature isomerization; and 50° to 150°F. for ultra-low temperature isomerization.

Patents disclosing low-temperature hydrocarbon isomerization processes include U.S. Pat. No. 3,180,905, which is directed to the use of an aluminum tribromide catalyst, and U.S. Pat. No. 3,227,772, which in general is directed to the use of a metal halide catalyst with hydrogen halide at temperatures in the range of about 50° to 350°F.

Catalysts used for middle to low-temperature range isomerization processes, e.g., 150°–500°F., include platinum on halided alumina wherein the halide content is above 1 weight percent and usually above 2 weight percent. Isomerization processes using these solid high-halide-content catalysts are disclosed, for example, in U.S. Pat. No. 2,999,074 and U.S. Pat. No. 2,927,087. The high halide content can be achieved by subliming a Friedel-Crafts component, such as aluminum chloride, onto the alumina support or treating the alumina support with an organic halide, such as carbon tetrachloride. Such catalysts can be used for isomerization at temperatures of about 300°F. and below.

For typical low-temperature isomerization the catlayst used in $AlCl_3$ plus hydrogen chloride. Low-temperature isomerization feedstock, dried and preheated to reaction temperature, is combined with a recycle stream (if recycling is practiced), mixed with hydrogen chloride, and passed through a reactor and an aluminum chloride recovery section. Reactor effluent is cooled and flashed to discharge any light gases through a small absorber that recovers hydrogen chloride carried off in the gases. Liquid from the flash drum is stripped to recover hydrogen chloride, and is caustic-washed to remove the last traces of acid. The stripping column is usually operated at a pressure high enough that the stripped hydrogen chloride can be returned directly to the reactor. If recycling of unconverted normal paraffin is practiced, the recycle stream is then fractionated from the product.

Typical reaction conditions are:

| | |
|---|---|
| Catalyst | $AlCl_3$-HCl |
| Inhibitor | $H_2$ (60 psi) |
| Pressure, psi | 300 |
| Temperature, °F. | 176–212 |
| Space velocity, V/hr/V | 1.0–2.5 |
| HCl conc., wt.% | 5 |
| Conversion % | 60 |

Ultra-low temperature isomerization so far has not been employed commercially to a significant extent. Patents which have disclosed ultra-low temperature isomerization process include U.S. Pat. No. 2,956,095, directed to the use of fluosulfonic acid catalysts. U.S. Pat. No. 3,201,494 is directed to ultra-low temperature isomerization using an HF·antimony pentafluroride catalyst in liquid phase and U.S. Pat. No. 3,394,202 is directed to use of a supported HF·antimony pentafluoride catalyst. U.S. Pat. No. 3,678,120 discloses the use of a supported HF antimony pentafluoride or fluosulfonic acid antimony pentafluoride catalyst for low-temperature isomerization much the same as in U.S. Pat. No. 3,394,202.

The prior art does not appear to disclose the combination of hydrocracking-low temperature isomerization of singly branched hexanes, particularly as described in the specific process combinations below.

SUMMARY OF THE INVENTION

According to the present invention, a process is provided for producing high octane low lead content or unleaded gasoline from a hydrocarbon feedstock, which process comprises hydrocracking the hydrocarbon feedstock, thereby obtaining a hydrocracking effluent comprising singly branched hexanes and $C_7$+ hydrocarbons; fractionating the hydrocracking effluent in a fractionation zone, thereby obtaining a stream rich in singly branched hexanes; isomerizing the singly branched hexanes to doubly branched hexanes in an isomerization zone operated at a reaction temperature below 300°F.; and combining the doubly branched hexanes with $C_7$+ hydrocarbons derived from the hydrocracking effluent, thereby obtaining a high octane gasoline or gasoline blending stock.

According to a preferred embodiment of the present invention, the fractionating is carried out to obtain a butane fraction, a pentane-hexane fraction and a $C_7$+ fraction, and the pentane-hexane fraction is fed to the isomerizing step.

According to another preferred embodiment of the present invention, the fractionating is carried out to obtain an isopentane-rich fraction and the pentane-hexane fraction is a normal pentane-hexane fraction.

Among other factors the present invention is based on my finding that hydrocracking integrated with isomerization to produce high octane gasoline even though hydrocracking itself produces isoparaffins and isomerization also produces isoparaffins. The isomerization step of the present invention must be carried out at a low temperature, i.e., below 300°F., and the feed to the isomerization step must include singly branched isohexanes produced in the hydrocracking step.

One reason the present invention is surprisingly advantageously integrated into an overall process to produce high octane unleaded or low lead content gasoline is that the present invention affords an especially advantageous feedstock for reforming to produce high octane material from that portion of the hydrocracking effluent that is not upgraded to the high octane doubly branched hexanes by isomerization. This is accomplished as follows: Hydrocracking produces a high yield of methylcyclopentane. In the low temperature isomerization step of the present invention methylcyclopentane is isomerized very advantageously to cyclohexane. Such isomerization is not nearly as advantageously carried out at high temperature because, although methylcyclopentane isomerizes to cyclohexane relatively easy, the extent of isomerization at high temperature is not very great as the thermodynamic equilibrium is considerably in favor of methylcyclopentane at high temperature. However, at the low temperature required in the isomerization step in accordance with the present invention, the thermodynamic equilibrium is considerably in favor of cyclohexane. The reason cyclohexane production is important is that cyclohexane is easily reformed to high octane benzene. Methylcyclopentane can be reformed to benzene but not as easily as can cyclohexane. To reform methylcyclopentane to benzene, methylcyclopentane first has to be converted to cyclohexane in the reformer reactor. The cyclohexane is then dehydrogenated to yield benzene. During the time it takes to isomerize methylcyclopentane to cyclohexane in the reforming zone, some cracking takes place with net loss to light ends such as methane, ethane, propane, butane and pentane. Because of this loss and because of other factors, the reforming yield of benzene from the cyclohexane feed is about 25 to 35 percent greater than the reforming yield of benzene from methylcyclopentane.

In accordance with an especially preferred embodiment of the present invention, the isomerization step effluent is fractionated to obtain a cyclohexane-rich fraction and the process of the present invention further comprises feeding the cyclohexane-rich fraction to a catalytic reforming step and combining $C_5$+ hydrocarbons produced in catalytic reforming with doubly branched hexanes produced in the isomerizing step of the present invention. In this especially preferred embodiment of the present invention, it will be understood that the $C_5$+ hydrocarbons from reforming include $C_7$+ hydrocarbons derived from the hydrocracking effluent although, of course, the majority of the $C_7$+ hydrocarbons derived from the hydrocracking effluent will have been catalytically reformed and thus upgraded in octane by the reforming step of the present embodiment of the invention. Also, of course, it will be understood that cyclohexane present in the cyclohexane-rich fraction to the reforming step is dehydrogenated to benzene in the reforming step.

The term "rich" is used herein to mean a fraction which contains at least 10 weight percent of the specified component and usually more than about 20 weight percent of the specified component. The specified component can be more than 50 weight percent of the fraction referred to as, for example, in the case of separating an isopentane-rich fraction.

Also, an inventive concept which is broader than the especially preferred embodiment mentioned aforesaid as well as being easily combined with the especially preferred embodiment of the present invention comprises operating a low-temperature isomerization step followed by fractionation to obtain a stream which is very rich in cyclohexane, for example 50 weight percent or more of cyclohexane, followed by feeding the very rich cyclohexane-rich fraction to reforming, carried out under mild conditions because of the ease of reforming cyclohexane to benzene. Mild reforming conditions can include the use of less halide in the reforming catalyst, for example below 0.2 weight percent halide instead of above 0.7 weight percent, and also the use of rhodium in the reforming catalyst instead of the conventional platinum.

The catalysts which can be used in the isomerizing step of the present invention are those catalysts which are effective for isomerizing singly branched hexanes to doubly branched hexanes at a reaction temperature below about 300°F. A particularly preferred catalyst for the low-temperature isomerization step of the present invention is HF·antimony pentafluoride supported on a porous solid carrier, preferably a fluorided alumina carrier. Catalysts such as the aforesaid supported HF·antimony pentafluoride are described further in commonly assigned patent application Ser. No. 268,296, filed July 3, 1972, entitled "Isomerization." As described in the above-identified application, it has been found especially important, in order to achieve a low deactivation rate with the supported HF·antimony pentafluoride catalyst, to use a high isobutane content in the feed to the isomerization reaction zone. Specifically, it is important to use 25 weight percent or more isobutane in the feed to the isomerization zone when using such a catalyst. In the process of the present invention, isobutane is produced in considerable amounts by the hydrocracking step. The isobutane produced in the hydrocracking step can advantageously be used to supply isobutane to the isomerizing step.

Other isomerization catalysts which can be used in the isomerizing step of the present invention include fluosulfonic acid, boron trifluoride with a hydrogen halide acid such as HF, HCl or HBr, metal halides such as aluminum, antimony and tantalum halides, preferably with the metal halide being in the form of a metal trihalide with excess hydrogen halide acid present. Suitable halides for use in the metal halide and in the hydrogen halide include chloride, fluoride and bromide. Solid catalysts with high halide contents such as are used in the Butamer process can also be used in the low temperature isomerizing step of the present invention and these catalysts include platinum or a Group VIII metal on a refractory support such as alumina and with a halide content in excess of about 2 weight percent, usually a halide content between about 3 and 15 weight percent. Suitable halides for these latter-mentioned catalysts are chloride, bromide and fluoride with chloride being especially preferred.

The hydrocracking step of the present invention employs a conventional hydrocracking catalyst which typically will comprise a Group VIB and/or Group VIII metal on an acidic porous refractory support. The Group VIB and/or Group VIII metal of the hydrocracking catalyst can be in compound form as, for example, in the form of the metal sulfide, metal oxide or metal halide. The carrier for the hydrocracking catalyst can be made acidic in various ways as, for example, by using silica with alumina instead of using pure alumina or pure silica, or by adding halide to the carrier in an amount ranging from about 0.2 weight percent up to about 3 weight percent but more usually only up to about 1.5 weight percent. Suitable halides for enhancing the acidity of the hydrocracking catalyst support include chloride, fluoride and bromide, with chloride being preferred. Crystalline aluminosilicate zeolites such as mordenite, faujasite, so-called zeolite Y and zeolite X, also can be used as part or all of the hydrocracking catalyst suppot and such zeolites, particularly in the hydrogen form, will provide acidity for the hydrocracking catalyst and can be used in conjunction with amorphous alumina to provide the necessary acidity for the hydrocracking catalyst. Because of the acidity of the conventional hydrocracking catalysts, substantial isomerization occurs during the hydrocracking reaction so that there is a relatively high percentage of isoparaffins such as isobutane, isopentane and singly branched isohexanes in the effluent from a hydrocracking process.

BRIEF DESCRIPTION OF THE DRAWING

The drawing is a schematic process flow diagram illustrating a preferred embodiment of the process of the present invention.

FURTHER DESCRIPTION AND EXAMPLE

Referring to the drawing, a hydrocarbon feed is introduced to hydrocracking zone 2 via line 1. Typical hydrocarbon feedstocks are gas oils boiling, for example, within the range 200° up to as high as 1000° or 1100°F. A typical gas oil feedstock boils between about 400° and 800°F. A recycle of an unconverted portion of the hydrocarbon feed is also introduced to hydrocracking zone 2 via line 3. Preferred operating conditions for the hydrocracking reaction zone include a temperature between 600° and 950°F., a pressure between 100 and 10,000 psig, and a hydrogen feed rate between 1,000 and 15,000 SCF per barrel of hydrocarbon feed. In the hydrocracking step of the present invention the hydrocarbon feedstock is converted to gasoline boiling range hydrocarbons, singly branched hexanes, isopentane, normal pentane, butanes, propane, ethane and methane. The term "gasoline boiling range hydrocarbons" is used herein to connote material boiling within the range of isopentane to about 400°or 450°F. Usually there is also a few percent of butanes in the product gasoline.

The effluent from the hydrocracking zone is passed via line 6 to fractionation zone 7. In fractionation zone 7 unconverted portions of the hydrocarbon feed are separated for return to the hydrocracking zone via line 3. Butanes and lighter hydrocarbons are also separated for removal via lines 8 and 9. As indicated previously, a portion of the isobutane may be used in isomerization zone 10 especially when the isomerization zone employs an HF·antimony pentafluoride catalyst.

According to the preferred embodiment of the invention shown in the drawing, isopentane is separated from the hydrocracking zone effluent and passed via line 12 to blending zone 13.

Normal pentane and hexanes are separated and passed via line 14 to isomerization zone 10.

The $C_5$ and $C_6$ fraction withdrawn from fractionation zone 7 via line 14 and fed to the isomerization zone includes singly branched hexanes produced in the hydrocracking zone. The $C_5$ and $C_6$ fraction is isomerized in the isomerization zone to produce isopentane and doubly branched hexanes. The doubly branched hexanes have a much greater octane than the singly branched hexanes which are produced in the hydrocracking zone. Temperatures used in the hydrocracking reaction zone range from 600° to 950°F., whereas temperatures used in the isomerization zone range from about 0° to 300°F. A portion of the effluent from isomerization zone 10 is delivered to fractionation zone 7 via line 4. Table II below lists the octane rating of various $C_6$ hydrocarbons. As can be appreciated from the Table, 2,2-dimethylbutane and 2,3-dimethylbutane, which are doubly branched hexanes, are about 20 to 30 octane numbers higher than the singly branched hexanes, 2-methylpentane and 3-methylpentane.

TABLE II

| Compound | Properties of Hexanes Boiling Point, °F. | F-1 Clear Octane No. |
|---|---|---|
| 2,2-Dimethylbutane | 121 | 91.8 |
| 2,3-Dimethylbutane | 136 | 103 |
| 2-Methylpentane | 140 | 73.4 |
| 3-Methylpentane | 145 | 74.5 |
| n-Hexane | 155 | 24.8 |
| Methylcyclopentane | 161 | 91.3 |
| Cyclohexane | 177 | 83.0 |
| Benzene | 176 | 110 |

Thus, the doubly branched hexanes are especially valuable in achieving a high octane gasoline with no lead or only low lead content.

The term "low lead content" is used herein to mean a lead content below about 3 cc's of lead compound, such as tetraethyl lead, per gallon of gasoline and usually below about 1.5 cc's of lead compound per gallon of gasoline.

Catalytic hydrocracking at 650°–950°F. produces substantial amounts of methylcyclopentane. The isomerizing step of the present invention is especially advantageous for isomerizing the methylcyclopentane to cyclohexane. The cyclohexane in turn is advantageously separated in fractionation zone 7 so that a cyclohexane-rich feedstock is obtained for feed to reforming zone 18. The cyclohexane-rich feedstock and/or $C_7$+ feedstock from the hydrocracking step is fed to reforming zone 18 via line 17 and is reformed to yield high octane aromatic-rich $C_5$+ hydrocarbons which are withdrawn from reforming zone 18 via line 19. Suitable reaction conditions for the reforming reaction zone include a temperature between 800° and 1,100°F., a pressure between atmospheric and 500 psig, and a catalyst such as platinum on alumina or preferably platinum-rhenium on an alumina support under processing conditions as are described further in U.S. Pat. No. 3,415,737.

The various components produced in accordance with the present invention include isopentane and dimethylbutanes which are withdrawn via line 20 from isomerization zone 10, isopentane from fractionation zone 7, $C_7$+ hydrocarbons withdrawn via lines 15 and 16 from the fractionation zone and $C_5$+ reformate withdrawn from the reforming zone via line 19. According to the preferred embodiment illustrated in the drawing, these various fractions are blended in zone 13 to obtain product high octane unleaded or low lead content gasoline withdrawn via line 21.

The following examples further illustrate the invention.

EXAMPLE 1

100,000 B/D of a Gulf Coast crude fraction boiling in the range of 500°–900°F. is hydrocracked at 1200 psig with a NiSn/SiAl catalyst to give 81,800 B/D of a $C_7$–400°F. boiling range product and 25,200 B/D of a $C_5$–$C_6$ product having the composition given in column 1, Table III. The hexane fraction of the latter is separated and isomerized at 70°F. with $SbF_5 \cdot HF/AlF_3$ catalyst to give a product having the composition given in column 2, Table III. The $C_6$ cyclics are separated from the latter and combined with the $C_7$–400°F. product from hydrocracking above. This mixture is reformed with Pt-Re/$Al_2O_3$ catalyst at 200 psig to give 69,200 B/D of 97 research octane (unleaded) $C_5$+ product. The pentane fraction from hydrocracking, the $C_6$ product from isomerization, and the $C_5$+ product from reforming are combined to give 93,800 B/D of $C_5$+ product having a 95 research octane number (unleaded).

EXAMPLE 2

The same crude fraction (100,000 B/D) as given in Example 1 is hydrocracked at 1,200 psig with a Pd/SiAl catalyst to give 88,200 B/D of a $C_7$–400°F. boiling range product and 22,300 B/D of a $C_5$–$C_6$ product having the composition given in column 3, Table III. The $nC_5$–$C_6$ fraction of the latter is separated and isomerized at 70°F. in the $SbF_5 \cdot HF/AlF_3$ catalyst to give a product having the composition given in column 4, Table III. The $C_7$–400°F. product from hydrocracking above is reformed with PtRe/$Al_2O_3$ catalyst at 200 psig to give 74,000 B/D of 97 research octane (unleaded) $C_5$+ product. The isopentane fraction from hydrocracking, the $C_5$–$C_6$ product from isomerization, and the $C_5$+ product from reforming are combined to give 96,400 B/D of $C_5$+ product having a 95 research octane number (unleaded).

TABLE III

| | 1 | 2 | 3 | 4 |
|---|---|---|---|---|
| $iC_5$ | 47.3 | — | 39.6 | 13.1 |
| $nC_5$ | 3.7 | — | 9.4 | 2.2 |
| 22DMB | 0.1 | 44.4 | 0.3 | 36.5 |
| 23DMB | 4.0 | 7.1 | 3.1 | 5.8 |
| 2MP | 20.7 | 17.8 | 18.3 | 14.6 |
| 3MP | 11.9 | 6.9 | 10.9 | 5.7 |
| nHex | 1.9 | 3.5 | 7.1 | 2.9 |

TABLE III-continued

| | 1 | 2 | 3 | 4 |
|---|---|---|---|---|
| $CyC_5$ | .5 | — | 0.5 | 0.9 |
| MCP | 8.9 | 1.8 | 9.8 | 1.8 |
| CH | .7 | 18.5 | 1.0 | 16.5 |
| Bz | .3 | — | — | — |

What is claimed is:

1. A process for producing high octane low lead content or unleaded gasoline from a hydrocarbon feedstock which comprises hydrocracking the hydrocarbon feedstock, thereby obtaining a hydrocracking effluent comprising singly branched hexanes and $C_7$+ hydrocarbons;

fractionating the hydrocracking effluent in a fractionation zone, thereby obtaining a stream rich in singly branched hexanes;

isomerizing the singly branched hexanes to doubly branched hexanes in an isomerization zone operated at a reaction temperature below 300°F.; and combining the doubly branched hexanes with $C_7$+ hydrocarbons derived from the hydrocracking effluent, thereby obtaining a high octane gasoline or gasoline blending stock.

2. The process in accordance with claim 1 wherein the fractionating is carried out to obtain a butane fraction, a pentane-hexane fraction and a $C_7$+ fraction, and wherein the pentane-hexane fraction is fed to the isomerizing step.

3. The process in accordance with claim 2 wherein the fractionating is carried out to obtain an isopentane-rich fraction and wherein the pentane-hexane fraction is a normal pentane-hexane fraction.

4. The process in accordance with claim 1 wherein the fractionating is carried out to obtain a cyclohexane-rich fraction and wherein the process further comprises feeding the cyclohexane-rich fraction to catalytic reforming, thereby obtaining a $C_5$+ hydrocarbon effluent from catalytic reforming; and combining the $C_5$+ hydrocarbons with said doubly branched hexanes.

5. The process in accordance with claim 1 wherein the isomerization is carried out by contacting the singly branched hexanes with a catalyst comprising HF·antimony pentafluoride supported on a porous solid carrier.

* * * * *